US008344525B2

(12) United States Patent
Eisentraut et al.

(10) Patent No.: US 8,344,525 B2
(45) Date of Patent: Jan. 1, 2013

(54) ELECTRICAL POWER INITIATOR SYSTEM AND METHOD

(75) Inventors: Rudy Eisentraut, Tucson, AZ (US); Charles M. De Lair, Pomerene, AZ (US); Jason M. Bain, Vail, AZ (US); Matthew A. Offolter, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1448 days.

(21) Appl. No.: 11/939,678

(22) Filed: Nov. 14, 2007

(65) Prior Publication Data

US 2012/0228884 A1 Sep. 13, 2012

(51) Int. Cl.
*F02B 63/04* (2006.01)

(52) U.S. Cl. ..... 290/1 R

(58) Field of Classification Search ..... 290/1 R
See application file for complete search history.

(56) References Cited

U.S. PATENT DOCUMENTS

| | | | | |
|---|---|---|---|---|
| 3,965,365 | A * | 6/1976 | Parr | 290/53 |
| 4,352,023 | A * | 9/1982 | Sachs et al. | 290/42 |
| 4,627,240 | A * | 12/1986 | Holmes | 290/53 |
| 4,638,173 | A * | 1/1987 | Milton | 290/52 |
| 5,477,748 | A * | 12/1995 | Kimura | 74/572.1 |
| 5,929,531 | A * | 7/1999 | Lagno | 290/53 |
| 2011/0271863 | A1 * | 11/2011 | Rastegar et al. | 102/202.7 |

* cited by examiner

*Primary Examiner* — Tho D Ta
(74) *Attorney, Agent, or Firm* — Renner, Otto, Boisselle & Sklar, LLP

(57) ABSTRACT

The disclosed system, device and method for an electrical power initiator generally includes: a starter in communication with a trigger system and a generator, wherein the trigger is configured to activate the starter in response to an accelerating force and the generator is configured to produce electrical power in response to the activation of the starter.

23 Claims, 4 Drawing Sheets

ELECTRICAL POWER INITIATOR SYSTEM AND METHOD

FIELD OF INVENTION

The present invention generally concerns systems and methods for generating electrical power; and more particularly, representative and exemplary embodiments of the present invention generally relate to systems, devices and methods relating to generating electrical power to initiate a thermal battery when launching a missile.

BACKGROUND OF INVENTION

Many modern weapon systems, particularly missile systems, include a variety of electronic components that require electrical power to function. These weapon systems face the problem of being able to deliver electrical power to their electronic systems after long periods of non-use, such as when the weapons are stockpiled. Many power sources, such as conventional batteries, tend to deteriorate over time and in extreme temperatures, making them unsuitable in weapons that must be stored for long periods and/or in hostile climate conditions. Consequently, many weapon systems rely on thermal batteries, which engage chemical reactions to generate electrical power upon activation. Since thermal batteries are not activated until they receive an external electrical impulse, they have a much longer shelf-life than other batteries, making them ideal in weapon systems that must be stored for long periods.

However, reliably generating the external electrical impulse to initiate a thermal battery is problematic. Initiating the thermal battery using conventional batteries faces the same battery-life issues discussed above, making them an unreliable source for the thermal battery initiation charge after being stored for long periods. Additionally, conventional batteries and other initiator mechanisms may be difficult to replace due to, for example, the design of certain weapon systems and logistical issues arising under wartime conditions. Conventional initiator mechanisms have the additional disadvantage that they may be accidentally triggered during shipping or field-handling operations, prematurely activating the thermal battery and neutralizing the capability of the weapon.

SUMMARY OF THE INVENTION

In various representative aspects, the present invention provides a starter in communication with a generator, the starter being suitably configured to drive the generator to produce electrical power. Exemplary features generally include: a trigger in communication with the starter, the trigger being suitably configured to activate the starter in response to an accelerating force.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the Claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications, and/or advantages will become apparent in light of certain exemplary embodiments recited in the detailed description, wherein:

Figure 1:
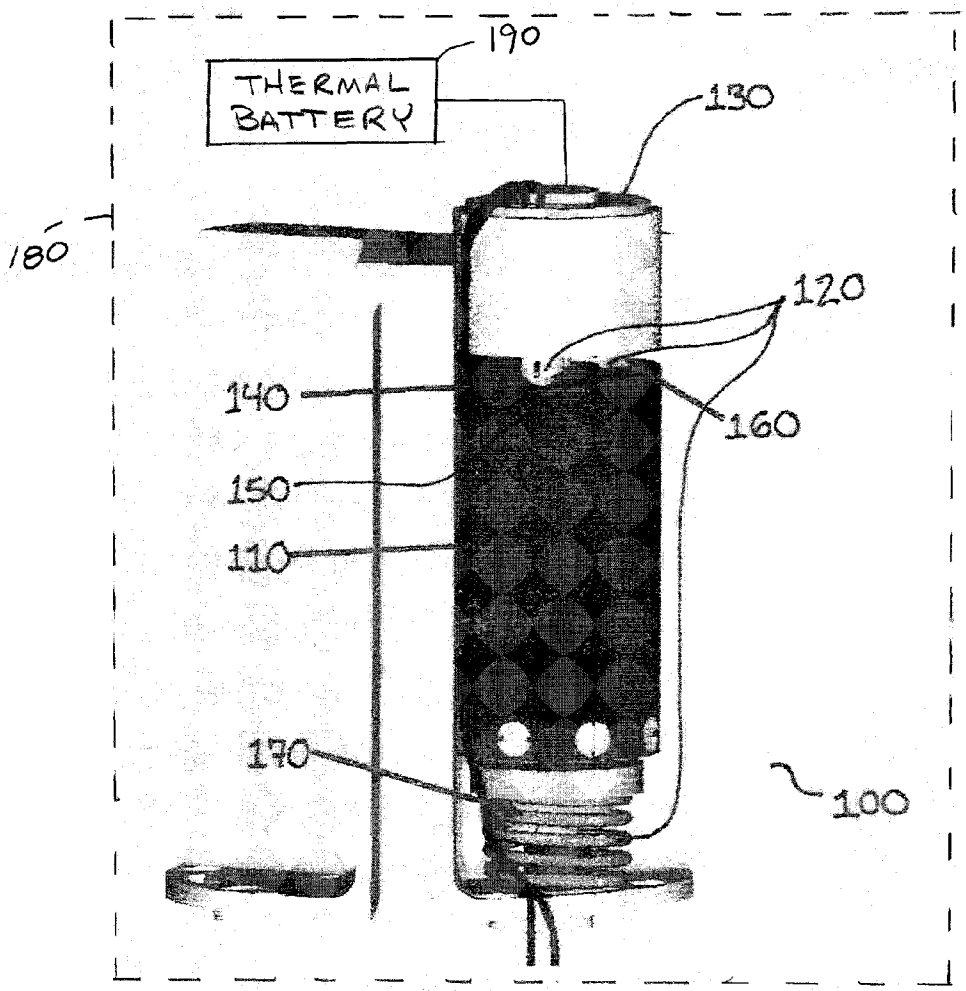
FIG. 1 representatively illustrates an isometric view of an electrical power initiator system according to various aspects of the present invention.

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", "forward", "aft", and the like in the Description and/or in the Claims, if any, are generally employed for descriptive purposes and not necessarily for comprehensively describing exclusive relative position. Any of the preceding terms so used may be interchanged under appropriate circumstances such that various embodiments of the invention described herein, for example, may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the scope, applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Various representative implementations of the present invention may be applied to any system for generating electrical power. Certain representative implementations may include, for example: the use of an electrical power initiator to start a thermal battery.

As used herein, the terms "generator", "power initiator," or any variation or combination thereof, are generally intended to include anything that may be characterized as or referred to a system suitably adapted to produce electrical power. A detailed description of an exemplary application, namely an electric power initiator for use in activating a thermal battery in a missile, is provided as a specific enabling disclosure that may be generalized to any application of the disclosed system, device, and method for electric power initiators in accordance with various embodiments of the present invention.

Various representative and exemplary embodiments of the present invention generally provide a system and method for generating electrical power in response to one or more accelerating forces. It will be appreciated that additional features may be readily adapted, extended, or otherwise applied to future electric power initiator designs. Accordingly, it will be further understood that the present invention is more generally directed to the generic conceptual approach of implementing an electric power initiator rather than merely disclosing specific module designs and/or combinatorial permutations.

As generally depicted in FIG. 1, an electric power initiator 100 in accordance with an exemplary embodiment of the present invention includes a starter 110 in communication with a triggering system 120 and a generator 130. In this exemplary embodiment, the triggering system 120 comprises a lower support spring 170 and a sear trip wheel 140, which moves along a ramp 150 to trip the sear 160. The lower support spring 170 resists the movement of the sear trip wheel 140 along the ramp 150 until the appropriate forces act on the electric power initiator 100 to depress the support spring 170 and rotate the sear trip wheel 140 along the ramp 150 to trip the sear 160.

In the present exemplary embodiment, the electric power initiator 100 is integrated with a tube-launched missile 180 to initiate a thermal battery 190 in response to the forces generated by the launch of the missile. The electric power initiator 100 may be integrated as part of any other suitable system, vehicle, device, and the like. The electric power initiator 100 may be suitably adapted to generate power for any appropriate device, electrical system, and electronic component.

Figure 2:
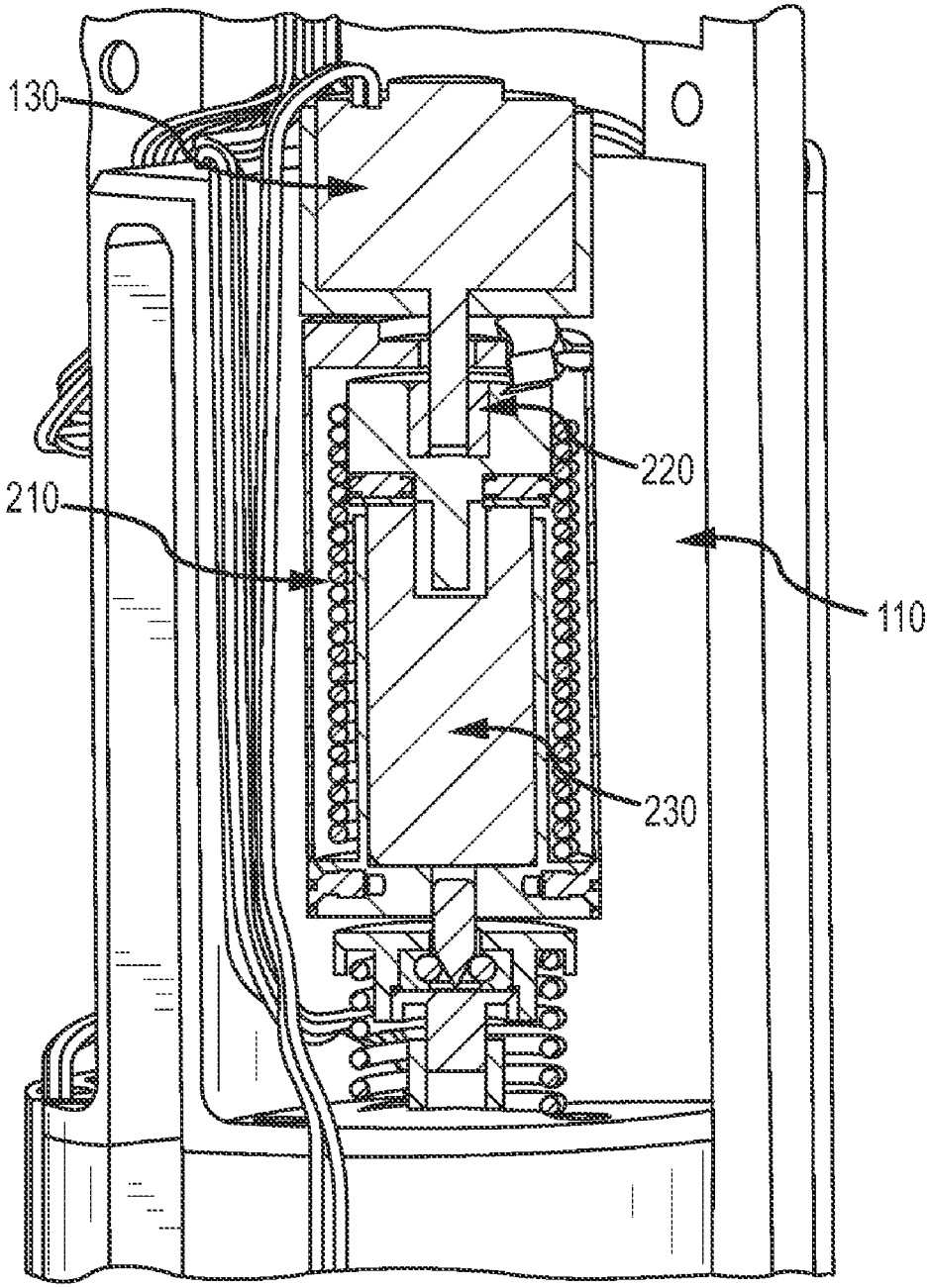
FIG. 2 representatively illustrates a cut-away view of the electrical power initiator system depicted in FIG. 1.
Figure 3A:
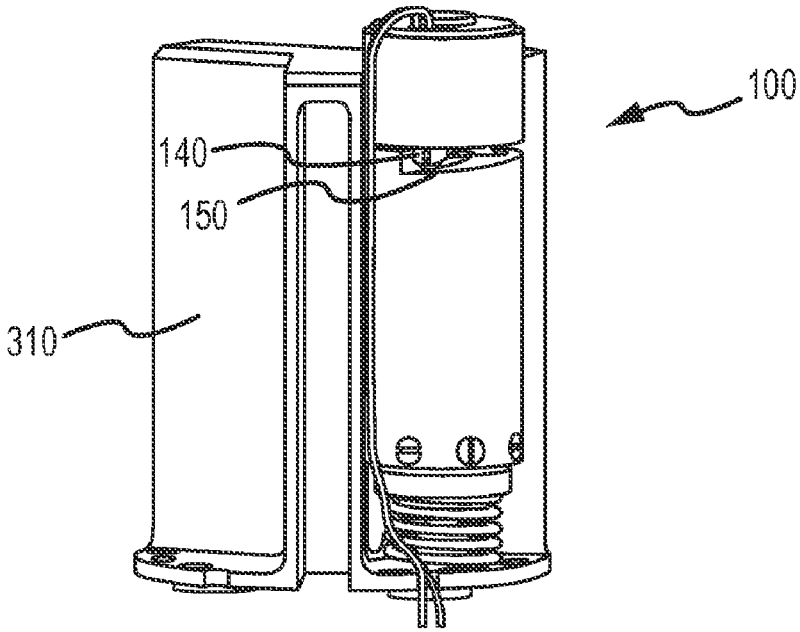
FIG. 3A, 3B, 3C, and 3D representatively illustrate the operation of an electrical power initiator system according to various aspects of the present invention.
Figure 3B:
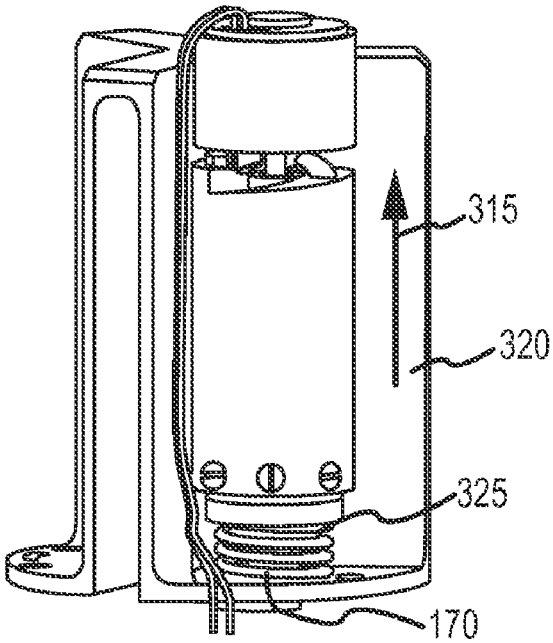
Figure 3C:
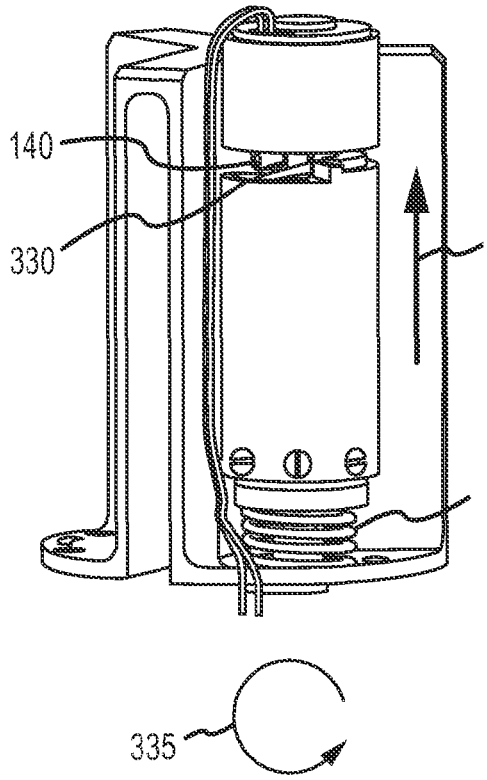
Figure 3D:
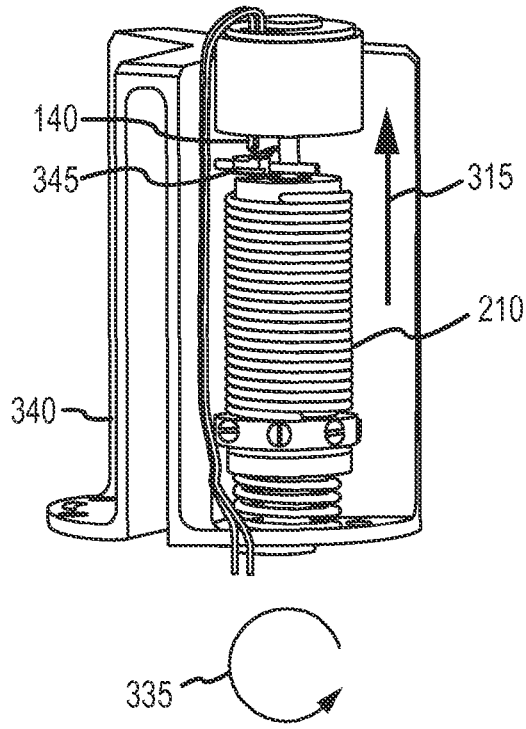

The starter 110 drives the generator 130 when activated by the trigger mechanism 120. In the present exemplary embodiment, referring now to FIG. 2, the starter 110 includes a torsion spring 210 in communication with a flywheel 220 and a ballast 230. In this embodiment, the torsion spring 210 is compressed prior to the triggering of the starter 110. When the starter 110 is triggered, the torsion spring 210 is released, spinning the flywheel 220, which in turn drives the generator 130. The ballast 230 acts to increase the moment of inertia (otherwise known as rotational inertia) of the flywheel 220, thereby increasing its kinetic energy. The starter 110 may include any other suitable mechanisms, systems, and devices to store energy and drive the generator 130 upon the triggering of the starter 110.

The trigger mechanism 120 activates the starter 110 in response to the presence of a predetermined force or set of forces. In the present exemplary embodiment, for example, the trigger mechanism 120 comprises a sear trip wheel 140, a ramp 150, a sear 160, and a lower support spring 170 which operate in conjunction to ensure the starter 110 is triggered when an appropriate set of forces are exerted on the electric power initiator 100. In this exemplary embodiment, the electric power initiator 100 is integrated in a tube-launched missile and is configured to activate the missile's thermal battery upon launch. When the missile is launched, the electric power initiator 100 experiences a longitudinal force that compresses the lower support spring 170, thereby reducing the tension on the sear trip wheel 140. Additionally, the missile rotates as it is launched, which generates a rotational force on the electric power initiator 100 and moves the sear trip wheel 140 up the ramp 150 to trip the sear 160 and activate the starter 110.

The trigger mechanism 120 may be implemented using any suitable system and device. The trigger mechanism 120 may be configured to activate the starter 110 in response to any number of forces of any appropriate magnitude, direction, and duration to achieve any suitable purpose. In the present embodiment, for example, the trigger mechanism 120 resists the accidental activation of the missile's thermal battery (such as from being dropped during shipping or field handling operations) by requiring the simultaneous exertion of both the longitudinal and rotational forces for a suitable duration of time.

The generator 130 produces electrical power in response to the initiation of the starter 110. The generator 130 may include any suitable device, system, electrical component, and the like capable of producing electrical power. In the present embodiment, for example, the generator 130 comprises an electric motor. The generator 130 may be configured to produce electric power having any appropriate characteristics. In the present embodiment, for example, the generator 130 produces electric power of sufficient magnitude and duration to activate the thermal battery on a missile.

In operation, referring now to FIGS. 3*a*, 3*b*, 3*c*, and 3*d*, an electrical power initiator 100 according to various aspects of the present invention generates electrical power in response to forces produced during the launch of a missile. Prior to launch (310), the lower support spring 170 resists the movement of the sear trip wheel 140 along the ramp 150. When the missile begins to launch (320), the longitudinal thrust 315 of the missile's engine compresses the lower support spring 170 (325), releasing the tension on the sear trip wheel 140. As the missile launches, it begins to rotate (330), generating a rotational force 335 on the electrical power initiator 100 and causing the sear trip wheel 140 to move along the ramp 150 towards the sear 160. As the longitudinal 315 and rotational 335 forces act on the electrical power initiator 100 for a sufficient duration and in sufficient magnitude (340), the sear trip wheel 140 continues up the ramp 150 and trips the sear 160 to activate the starter 110 (345). Activation of the starter (345) releases a torsion spring 210 that spins the flywheel 220 and drives the generator 130 to produce electrical power of sufficient magnitude and duration to activate the missile's thermal battery.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. An electrical power initiator, comprising:

a starter;

a trigger in communication with the starter, wherein the trigger is configured to activate the starter in response to an accelerating force; and a generator in communication with the starter, wherein the generator is configured to produce electrical power in response to the activation of the starter;

wherein the starter comprises a flywheel in communication with a torsion spring and the generator, wherein the starter is configured to release the torsion spring to rotate the flywheel and drive the generator upon activation of the starter.

2. The electrical power initiator according to claim 1, wherein the starter further comprises a ballast in communication with the torsion spring and the flywheel, wherein the ballast is suitably configured to increase the moment of inertia of the flywheel.

3. An electrical power initiator, comprising:

a starter;

a trigger in communication with the starter, wherein the trigger is configured to activate the starter in response to an accelerating force; and a generator in communication with the starter, wherein the generator is configured to produce electrical power in response to the activation of the starter;

wherein the trigger comprises a wheel movably connected to a ramp, the wheel being configured to move along the ramp in response to the accelerating force to activate the starter.

4. The electrical power initiator according to claim 3, wherein the ramp comprises a substantially circular shape, and wherein the wheel is configured to rotate about the circumference of the ramp in response to the accelerating force to activate the starter.

5. The electrical power initiator according to claim 3, further comprising a compression spring responsive to the accelerating force, wherein the compression spring is configured to substantially resist the motion of the wheel along the ramp until acted upon by the accelerating force.

6. A method for generating electrical power, said method comprising the steps of:

providing a starter;

providing a trigger in communication with the starter, wherein the trigger is configured to activate the starter in response to an accelerating force; and providing a generator in communication with the starter, wherein the generator is configured to produce electrical power in response to the activation of the starter;

wherein the step of providing the trigger comprises:

providing a wheel movably connected to a ramp, wherein the wheel is configured to move along the ramp in response to the accelerating force to activate the starter.

7. The method of claim 6, wherein the ramp comprises a substantially circular shape, and wherein the wheel is configured to rotate about the circumference of the ramp in response to the accelerating force to activate the starter.

8. The method of claim 6, further comprising providing a compression spring responsive to the accelerating force, wherein the compression spring is configured to substantially resist the motion of the wheel along the ramp until acted upon by the accelerating force.

9. An electrical power initiator comprising:

a starter;

a trigger that releases the starter in response to both a rotational acceleration and a longitudinal acceleration; and a generator that produces electrical power in response to movement of the starter, when the starter is released by the trigger.

10. The electrical power initiator of claim 9, wherein the trigger is a mechanical trigger.

11. The electrical power initiator of claim 9, wherein the generator includes an electrical motor.

12. The electrical power initiator of claim 9, wherein the starter includes a flywheel that spins when the starter is released, with the flywheel coupled to the generator such that the spinning flywheel powers the generator.

13. The electrical power initiator of claim 12, wherein the starter also includes a torsion spring around the flywheel, wherein, when the starter is released, the torsion spring spins the flywheel.

14. The electrical power initiator of claim 13, wherein the starter also includes ballast that rotates with the flywheel, wherein the ballast increases a moment of inertia of the flywheel.

15. The electrical power initiator of claim 9, wherein the trigger includes a spring coupled to the starter, such that release of the starter includes movement of the starter by the longitudinal acceleration, against force of the spring.

16. The electrical power initiator of claim 15, wherein the trigger also includes a trip wheel that moves along a ramp such that release of the starter includes movement of the trip wheel along the ramp, by the longitudinal acceleration.

17. The electrical power initiator of claim 16, wherein the trigger also includes a sear; and wherein movement of the trip wheel along the ramp, as part of the release of the starter, includes tripping of the sear.

18. The electrical power initiator of claim 16, wherein the spring acts on the ramp to resist movement of the trip wheel along the ramp, until the starter moves by the longitudinal acceleration, against the force of the spring.

19. The electrical power initiator of claim 9, in combination with a thermal battery that is operatively coupled to the generator; and wherein, when the starter is released by the trigger, the generator generates electric power of sufficient magnitude and duration to activate the thermal battery.

20. The combination of claim 19, wherein the electrical initiator and the thermal battery are parts of a missile; and wherein launch of the missile generates both the rotational acceleration and the longitudinal acceleration that causes release of the starter by the trigger.

21. An electrical power initiator comprising:

a starter;

a trigger that releases the starter in response to an acceleration of the entire electrical power initiator; and a generator that produces electrical power in response to movement of the starter, when the starter is released by the trigger.

22. The electrical power initiator of claim 21, wherein the starter includes:

a flywheel that spins when the starter is released, with the flywheel coupled to the generator such that the spinning flywheel powers the generator; and a torsion spring around the flywheel, wherein, when the starter is released, the torsion spring spins the flywheel; and wherein the trigger includes:

a spring coupled to the starter, such that release of the starter includes movement of the starter by a longitudinal acceleration, against force of the spring; and a trip wheel that moves along a ramp such that release of the starter includes movement of the trip wheel along the ramp, by the longitudinal acceleration.

23. The electrical power initiator of claim 21, in combination with a thermal battery that is operatively coupled to the generator; and wherein, when the starter is released by the trigger, the generator generates electric power of sufficient magnitude and duration to activate the thermal battery.

* * * * *